US007374501B2

(12) United States Patent
Lu

(10) Patent No.: US 7,374,501 B2
(45) Date of Patent: May 20, 2008

(54) GOLF ACCESSORIES

(76) Inventor: Li Han Eden Lu, Flat H, 13/F, Block 3, Park Central, 9 Tong Tak Street, Tseung Kwan O, New Territories, Hong Kong (CN)

( * ) Notice: Subject to any disclaimer, the term of this patent is extended or adjusted under 35 U.S.C. 154(b) by 16 days.

(21) Appl. No.: 11/425,774

(22) Filed: Jun. 22, 2006

(65) Prior Publication Data

US 2007/0298909 A1 Dec. 27, 2007

(51) Int. Cl.
*A63B 57/00* (2006.01)

(52) U.S. Cl. ..... 473/396; 473/393

(58) Field of Classification Search ..... 473/387–403
See application file for complete search history.

(56) References Cited

U.S. PATENT DOCUMENTS

| | | | | |
|---|---|---|---|---|
| 2,723,126 | A * | 11/1955 | Spluvak | 473/396 |
| 4,524,974 | A | 6/1985 | Matsuura | |
| 4,610,451 | A * | 9/1986 | Keys | 473/268 |
| 4,989,869 | A | 2/1991 | Lackey | |
| 5,242,170 | A | 9/1993 | Ward | |
| 5,728,013 | A | 3/1998 | Luther, Sr. | |
| 5,776,014 | A | 7/1998 | Gustine | |
| 6,004,228 | A | 12/1999 | Adam | |
| 6,186,907 | B1 * | 2/2001 | Woodward | 473/400 |
| 6,682,443 | B1 * | 1/2004 | Liu | 473/387 |
| 6,783,470 | B2 * | 8/2004 | Lee | 473/401 |
| 2003/0181262 | A1 | 9/2003 | Lee | |
| 2004/0018896 | A1 | 1/2004 | Liu | |
| 2004/0152542 | A1 | 8/2004 | Blum et al. | |
| 2004/0166964 | A1 | 8/2004 | Toyosawa et al. | |
| 2005/0143195 | A1 | 6/2005 | Syu | |
| 2006/0105861 | A1 * | 5/2006 | Yang | 473/396 |
| 2006/0229144 | A1 * | 10/2006 | Lee | 473/393 |
| 2007/0111825 | A1 * | 5/2007 | Lee | 473/386 |

FOREIGN PATENT DOCUMENTS

| | | | |
|---|---|---|---|
| CN | 1524596 | A | 9/2004 |
| GB | 2252049 | A1 | 7/1992 |
| GB | 2334218 | A1 | 8/1999 |
| WO | 2004/101080 | A1 | 11/2004 |
| WO | 2005/032668 | A1 | 4/2005 |

* cited by examiner

*Primary Examiner*—Steven Wong
(74) *Attorney, Agent, or Firm*—William J. Sapone; Colemans Sudol Sapone P.C.

(57) ABSTRACT

There is provided a golf tee comprising a ground-engaging portion provided with a cavity therein, a golf ball supporting portion releasably engageable with the ground-engaging portion, means for connecting the ground-engaging portion and the golf ball supporting portion, and spring means for urging said golf ball supporting portion to the ground-engaging portion, wherein the spring means resides and is movable in the cavity.

18 Claims, 7 Drawing Sheets

GOLF ACCESSORIES

FIELD OF THE INVENTION

This invention relates to golf tees, parts of the golf tees and kits having such golf tees and parts.

BACKGROUND OF THE INVENTION

There are a variety of conventional golf tees in the markets. Typically, a golf tee acts as a stand on which a golf ball can sit and raise the ball above the ground. Most golf tees are designed with a view to assist the movement of the ball and seeks to increase the flight distance of the golf ball. It is fairly typical that a golfer will have many golf tees in his golf bags because golf tees tend to break easily. Also, a golfer may often also have different types of golf tees so that he or she may choose whichever suitable one for use in a particular situation. Publications on conventional golf tees include U.S. Pat. No. 4,524,974, published UK Patent Application No. 2,5252,049A, U.S. Pat. No. 5,728,013, published UK Patent Application No. 2,334,218A, U.S. Pat. No. 6,004,228, U.S. Pat. No. 4,989,869, U.S. Pat. No. 5,776,014, U.S. Pat. No. 5,242,170, published US Patent Application No. 2004/0018896, published US Patent Application No. 2003/0181262, published International Application No. WO2004/101080, published International Application No. WO2005/032668, published US Patent Application No. 2005/0143195, published US Patent Application No. 2004/0152542 and published US Patent Application No. 2004/0166964, the contents of all of which are incorporated in their entirety herein for reference.

SUMMARY OF THE INVENTION

According to a first aspect of the present invention, there is provided a golf tee comprising a ground-engaging portion provided with a cavity therein, a golf ball supporting portion releasably engageable with the ground-engaging portion, means for connecting the ground-engaging portion and the ball supporting portion, and spring means for urging said golf ball supporting portion to the ground-engaging portion, wherein the spring means resides and is movable in the cavity. The configuration of having the ball supporting portion separable from the ground-engaging portion reduces the chance of breakage of the golf tee. Further, on impact the ball supporting portion can move forward, thus reducing the absorption of momentum in a swing thereby and this further translates to an increase in flight distance of the golf ball. Studies have shown that up to 30 to 40 lbs of force could be lost when a golf club hits a conventional golf tee which is generally integral in construction. The absence of the spring means in the golf tee supporting portion assists in reducing the design requirement in terms of the minimal length or height of the golf ball supporting portion.

Preferably, the cavity may generally be elongate in shape and leads to an upper opening arranged at the top of the ground-engaging portion. The absence of an elongate cavity in the golf ball supporting portion also assists in reducing the design requirement on the minimal length or height of the golf ball supporting portion. The opening may have a smaller width or diameter than the width or diameter of the elongate cavity.

Suitably, the connecting means may be resilient in nature or it may be made of a plastic(s) material. In one embodiment, the connecting means may generally be elongate in shape with a lower end having an enlarged flange secured in the cavity. In particular, the flange of the connecting means may be movable along the elongate cavity. With this configuration, the lower end of the connecting means can be retained below the opening and secured in the cavity.

In another embodiment, the connecting means may be provided with a lower end which is secured within the cavity of the ground-engaging portion. In particular, the spring means may act on the lower end of the connecting means and pushes the lower end towards a lower end of the cavity or a portion region of the ground-engaging portion. The spring means may for example be in the form of a compression spring acting on the lower end of the connecting means.

Advantageously, the ball supporting portion may comprise a base portion and an upper portion releasably engageable to the base portion. In one embodiment, the upper portion may be threadedly engageable to the base portion. The connecting means may connect the base portion of the ball supporting portion to the ground-engaging portion in the cavity. The upper portion may be replaceable with another upper portion of similar length and/or inclination. This is useful if the upper portion is damaged because only the upper portion is then replaced.

Preferably, the golf ball supporting means may be provided with means for assisting the leveling of the golf tee on the ground. In one embodiment, the leveling assisting means may be releasably engageable with the golf tee or the golf ball supporting means. In particular, the assisting means may be threadedly engageable to the golf ball supporting portion. The provision of the leveling assisting means can assist a user to accurately insert the tee on the golf ground at a right angle or a desired inclination. The releasably engageable nature of the leveling assisting means allows replacement of itself or the upper portion of the golf ball supporting means (but excluding the leveling assisting means) only should it be damaged.

In one embodiment, the golf ball supporting means may generally be elongate in shape and is slightly angled relative to the ground-engaging portion and/or is slightly curved. This configuration assists in minimizing contact or reducing impact on the ball supporting means by a golf club.

According to a second aspect of the present invention, there is provided a golf tee comprising a ground-engaging portion, and a golf ball supporting portion releasably engageable with the ground-engaging portion, wherein the golf tee is adapted to assume a first configuration in which the ball supporting portion is in contact with the ground-engaging portion and a second configuration in which the golf ball supporting portion is out of contact with the ground-engaging portion, and wherein the golf tee further comprises a spring means for resiliently biasing or urging the ball supporting means towards the ground engaging means, and the spring means of which resides and is movable in the ground-engaging portion.

According to a third aspect of the present invention, there is provided a golf tee comprising a ground-engaging portion, a golf ball supporting portion having an upper portion on which a golf ball can sit thereon and a lower portion releasably engageable with the ground engaging, and means for connecting the lower portion to the ground engaging means and urging the lower portion or the ground-engaging portion towards the ground-engaging means, wherein the upper portion is threadedly and releasably engageable with and releasably removable from the lower portion, and wherein the lower portion is connected to the ground-engaging portion.

According to a fourth aspect of the present invention, there is provided a kit of golf accessory comprising at least two golf tees, at least one of which is described in one of the aspects of the above invention.

BRIEF DESCRIPTION OF THE DRAWINGS

Embodiments of the present invention are now described, by way of examples only, with reference to the following drawings in which.

DETAILED DESCRIPTION OF THE PREFERRED EMBODIMENTS

Figure 1:
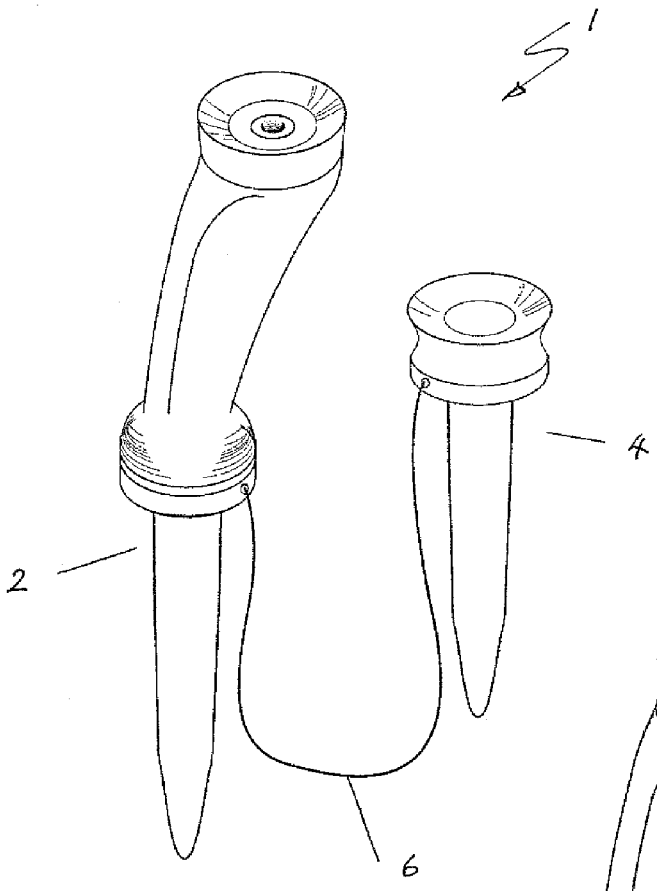
FIG. 1 is a perspective view showing a set of two golf tees including a longer golf tee and a shorter golf tee.
Figure 2:
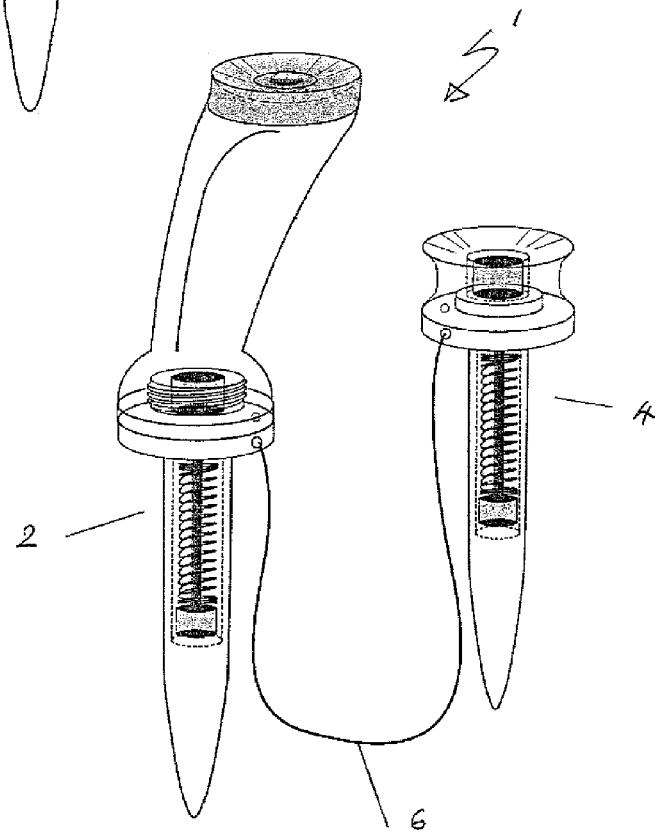
FIG. 2 is a schematic view of the golf tees shown in FIG. 1 showing the internal structure thereof.

Turning to the figures, a first embodiment of a set of golf tees or golf accessory in accordance with the present invention is shown in FIGS. 1 to 14. Referring to FIG. 1 to 2, there is shown a set of two golf tees, generally designated 1, with a longer golf tee 2 connected to a shorter golf tee 4 by a string 6.

Figure 3:
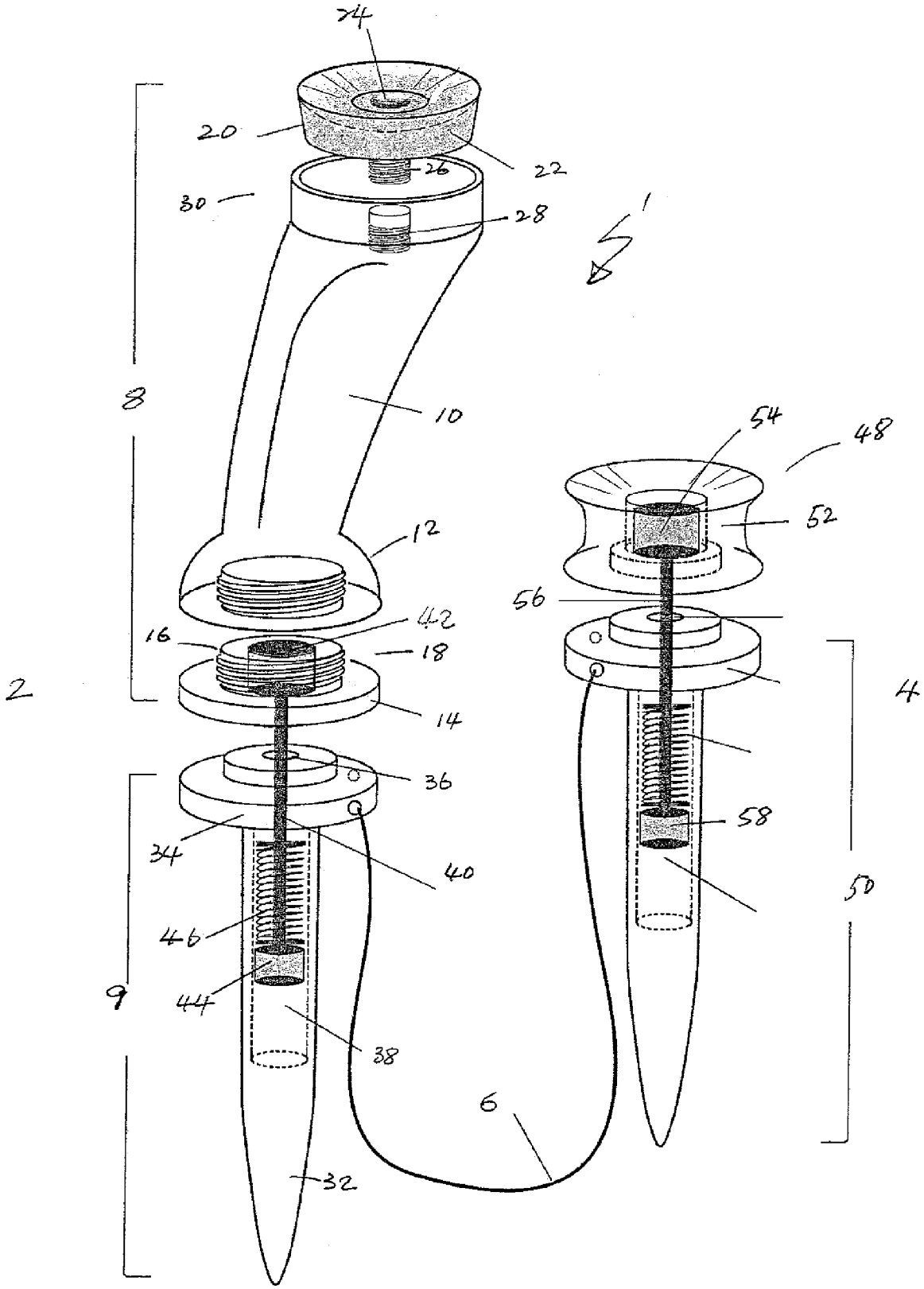
FIG. 3 is an exploded view showing the golf tees in FIG. 2, FIGS. 4*a* to 4*e* are schematic views showing some of the components of the golf tees of FIG. 1.
Figure 4A:
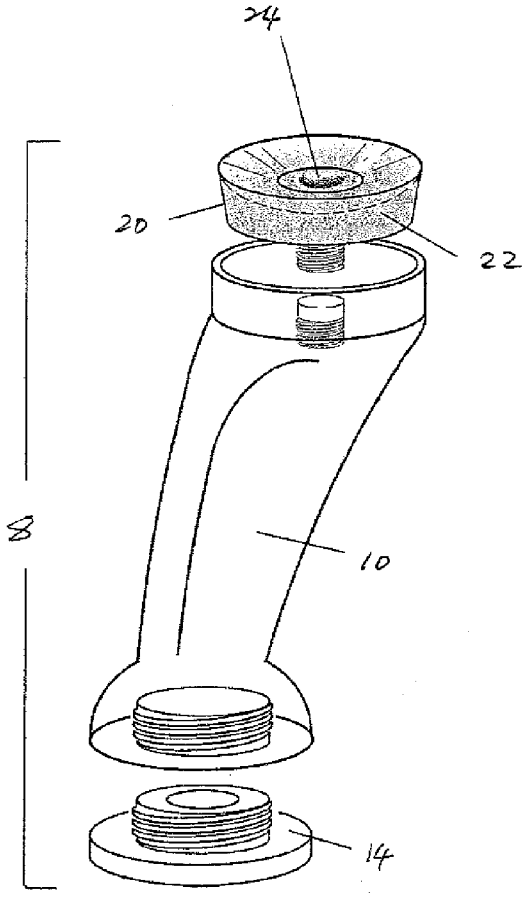
Figure 4B:
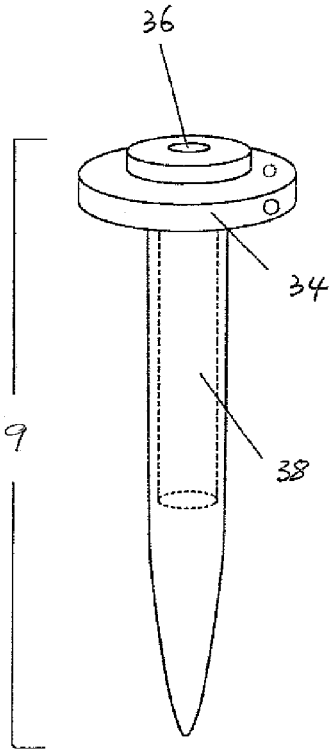
Figure 4C:
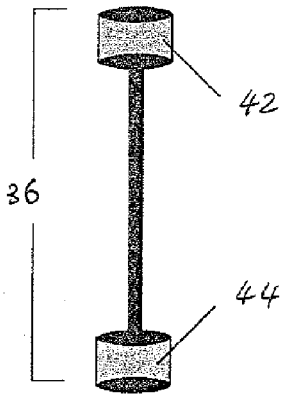
Figure 4D:
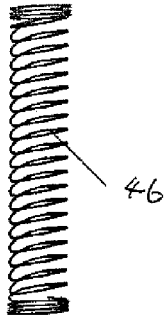
Figure 4E:
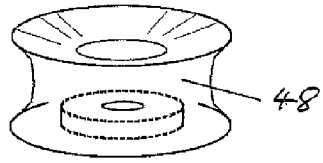

As shown in FIGS. 3 and 4*a*, the longer golf tee 4 has a golf ball supporting portion 8 arranged above a ground engaging portion 9. The ball supporting portion 8 is generally elongate in shape and is inclined in relation to the ground engaging portion 9 or the general longitudinal axis of the portion 9 or the golf tee 2. The ball supporting portion 8 is provided with an upper portion 10 having a slightly enlarged lower end 12 which is internally threaded and a base 14 which is generally in the form of a disc member 14 but provided with an externally threaded protrusion 16 on the upper side 18 thereof. The lower end 12 of the upper portion 10 is releasably and threadedly engageable with the protrusion 16 of the base 14. The ball supporting portion 8 is further provided with means 20 for assisting leveling and insertion of the golf tee 2 on a golf ground. The means 20 is generally in the form of a disc 20 provided with a concave surface 22 at the upper end thereof on which a golf ball can sit. When viewing from above the leveling assisting means, a circle is seen in the middle of the leveling assisting means 20. The disc 20 is made of a generally transparent material and has a cavity therein filled with a liquid. The cavity is also introduced with an air bubble 24 suspended in the liquid. The bottom of the disc 20 is provided with an externally threaded protrusion 26 for releasable engagement with an internally threaded recess 28 provided at an upper end 30 of the ball supporting portion 8. Referring to FIG. 3, the ground-engaging portion 9 of the longer tee 2 is provided with an elongate spike shaped member 32 for insertion into a golf ground. The upper end of the spike 32 is provided with a laterally extending flange 34 and also an opening 36 at the center of the flange 34. A cavity 38, which is elongate in shape, extends along the interior of the spike 32 and leads to the opening 36 at the flange 34.

The longer golf tee 2 is further provided with means for connecting and/or urging the golf ball supporting portion towards the ground engaging portion such that the golf tee as a whole on insertion to a golf ground can support a golf ball in use. The means includes a resilient member 40 which is elongate in shape and is relatively thin. The resilient member 40 has two symmetric ends 42, 44, each of which is enlarged in relation to the resilient member 40 and is in the shape of a short cylindrical block. The lower enlarged end 44 is arranged in the cavity 38 of the ground-engaging portion 9 and the upper enlarged end 42 resides in and fixedly engages with the base 14 via the bottom of the disc 14. Since the base 14 is normally threadedly engaged with the upper portion 10 of the ball-supporting portion 8, the resilient member 40 is in effect attached at its upper end to the base 14 and also to the ball supporting portion 8. The means is also provided with a compression spring 46 resided in and along the cavity 38. Since both the compression spring 46 and the lower enlarged end 44 have a larger width than that of the opening 36, they are retained in the cavity 38. In particular, the configuration of the spring 46 and the resilient member 40 is that the spring 46 is arranged above the lower enlarged end 44 in the cavity 38. Unlike the upper enlarged end 42, the lower enlarged end 44 resides in the cavity 38 of the ground-engaging portion 9 and is movable along the cavity 38 although there is a downwardly biasing force acting on the lower enlarged end 44 by the spring 46.

Figures 5, 6:
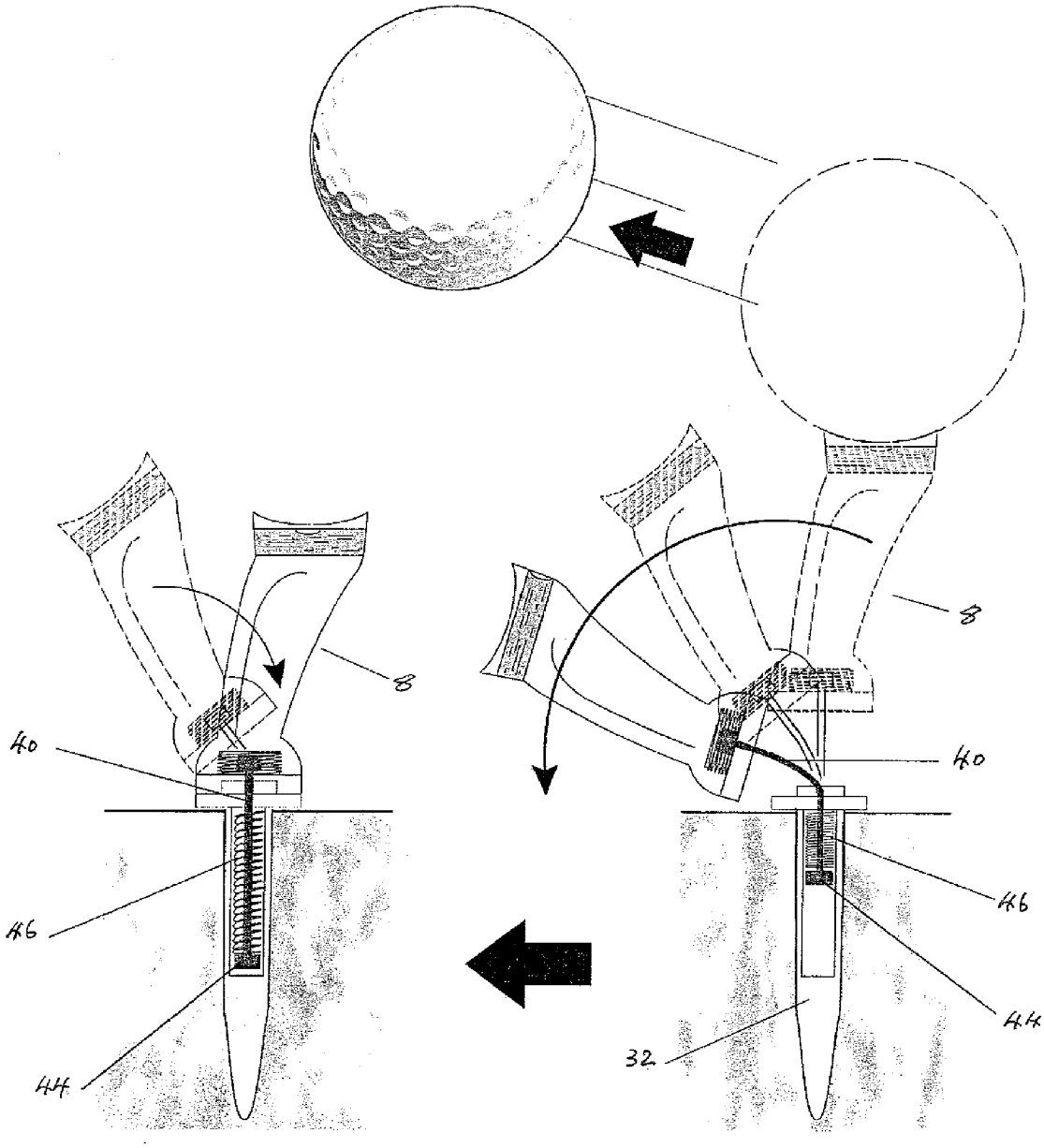
FIG. 5 illustrates a change of configuration of the longer golf tee when a golf ball sat thereon is hit by a golf club, FIG. 6 illustrate a change of configuration of the golf tee from FIG. 5 after the golf ball has been hit by golf club.

Referring to FIGS. 5 to 6, after the ground-engaging portion 9 of the golf tee 2 is inserted into a golf ground and the flange 34 touches the golf ground, a golf ball is placed on the golf supporting portion 8. As the ball is hit by a golf club, the ball takes off at the direction of the hit while the ball supporting portion 8 tends to move forward towards the ground. As the ball supporting portion 8 is moving forward it pulls on the upper enlarged end 42 of the resilient member 40 which in turns moves the lower enlarged end 44 of the resilient member 40 resided in the cavity 38 against the biasing force from the spring 46. However, as the spring 46 is compressed and when it stores enough energy as it will come to a point when it starts to expand and releases the stored energy by downwardly pushing the lower enlarged end 44 and which in turns pulls the upper enlarged end 42 of the resilient member 40 and also the ball supporting portion 8 connected thereto back to the original default position as shown in FIG. 2. It is thus illustrated that the golf tee 2 is adapted to assume a first configuration in which the golf ball supporting portion 8 is in contact with the ground-engaging portion 9 or it is adapted to assume a second configuration in which the golf ball supporting portion is out of contact with the ground-engaging portion.

The shorter golf tee 4 is generally similar to the longer golf tee 2 in terms of the general principle of operation but with differences to be explained as follows. Similar to the longer golf tee 2, the shorter golf tee 4 also comprises a ball supporting portion 48 and a ground-engaging portion 50.

Figures 13, 14:
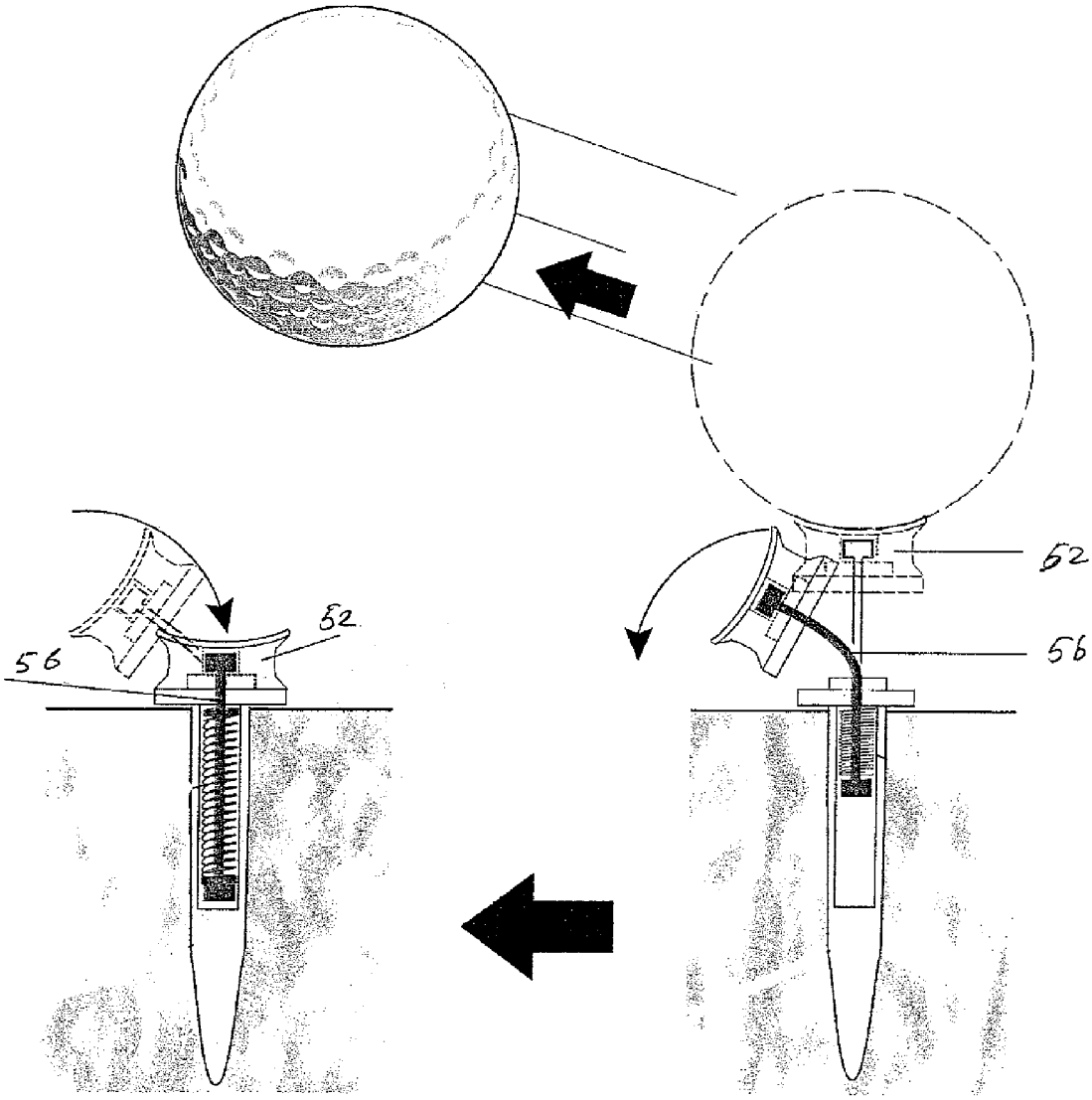
FIG. 13 illustrates a change of configuration of the shorter golf tee when a golf ball sat thereon is hit by a golf club, FIG. 14 illustrate a change of configuration of the golf tee from FIG. 13 after the golf ball has been hit by a golf club.

The ground-engaging portion 50 is generally similar in construction to that of the longer golf tee 9. As shown in FIGS. 2 and 3, the supporting portion 48 is however different in that it is not divided into three parts of a leveling assisting means, an upper portion and a base. Instead, it is essentially one integral member 52 with a ball seat portion on the top. Similar to the golf tee 2, this golf tee 4 is also provided with a connecting means 56 with an enlarged end in the form of a short cylindrical block 54 connected thereto via its bottom. The connecting means 56 is also provided with a lower enlarged end 58 engaged with the ground-engaging portion 50 similar to that in the longer tee 2 and the description is not to be repeated here. The shorter golf tee 4 operates according to a generally similar principle, as shown in FIGS. 13 and 14.

Figure 7:
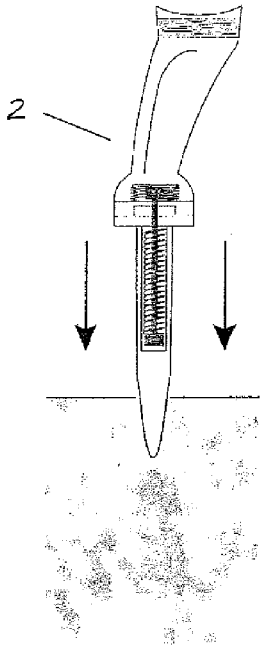
FIGS. 7 to 11 illustrate ways of inserting the longer golf tee in a golf ground.
Figures 9, 10, 11:
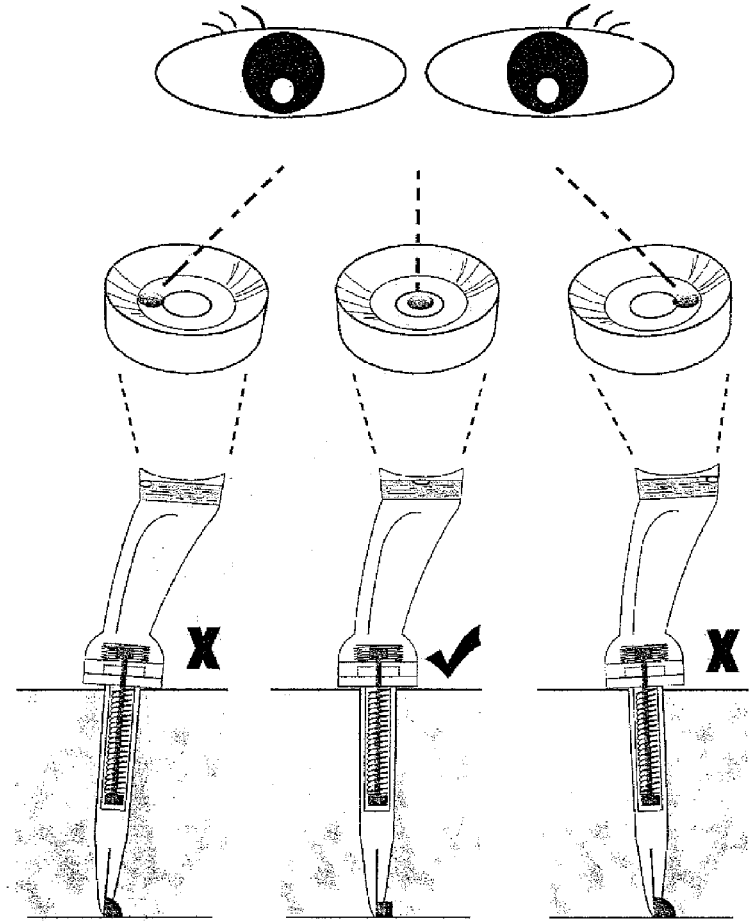
Figure 8:
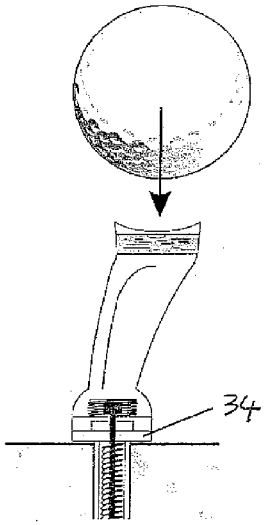
Figure 12:
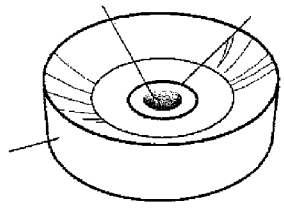
FIG. 12 is a perspective view showing a leveling device for use with the golf tee.

FIGS. 7 to 12 illustrate the insertion of the golf tee 2 into a golf ground. Typically, the golf tee 2 is to be inserted such that it is perpendicular to a horizontal level as shown in FIGS. 7 and 8. However, this may not always be easy because the golf ground at a particular location may not be flat. The golf tee 2 is provided with the leveling assisting means 20 seeking to assist a user to insert the golf tee 2 to the golf ground properly. If or when the golf tee 2 is inserted properly, the bubble 24 in the leveling assisting means will reside in the middle portion thereof within the circle, as shown in FIG. 10. However, if the bubble 24 moves to a side outside the circle (as shown in FIGS. 9 and 11) then the user can pull out the tee 2 and re-insert it at a slightly different angle in order to position the golf tee 2 at a right angle. Alternatively, the user can simply jiggle the golf tee 2 until the bubble 24 moves to the center of the leveling assisting means 20. FIG. 12 is an enlarged view showing the leveling assisting means 20.

It is to be noted that the above golf tees 2, 4 are connected together by the string 6 for a reason. It is envisaged that in a situation where only the longer golf tee 2 is to be used to support a golf ball, the shorter golf tee 2 connected thereto may also be inserted to a nearby golf ground adjacent to the longitudinal golf tee 2 such that in the event when an unexpectedly large impact is sustained by the longer golf tee 2 causing it to be totally lifted off from the ground, the shorter golf tee 4 serves as an insurance to prevent the longer golf tee 2 from being thrown far away into, for example, nearby bushes, trees, etc.

Although the above embodiment is illustrated showing two golf tees 2, 4 connected together, in a second embodiment in accordance with the present invention, only one or the other may be produced and sold as a single item.

Figure 15:
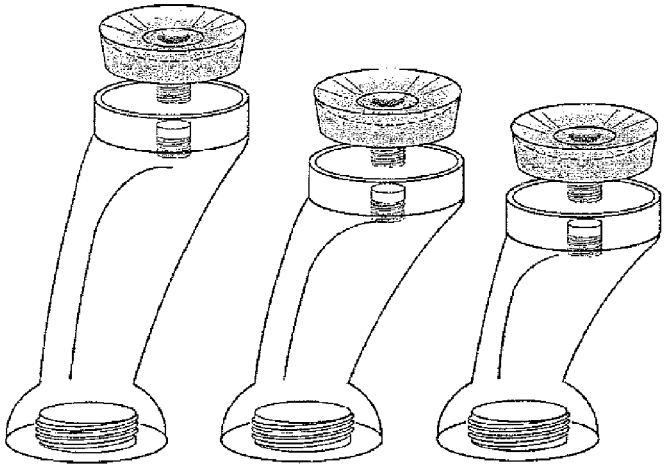
FIG. 15 is a schematic view showing three golf ball engaging portions in different length.

In a third embodiment in accordance with the present invention, there is provided a golf tee similar to the longer golf tee. However, the upper portion may be of different or shorter length, as shown in FIG. 15. Alternatively, upper portions of different length may be provided in a golf tee kit or a kit of golf accessories having a number of upper portions of different length such that a user may choose which of the upper portions for their use in a particular terrain or hit.

Figure 16:
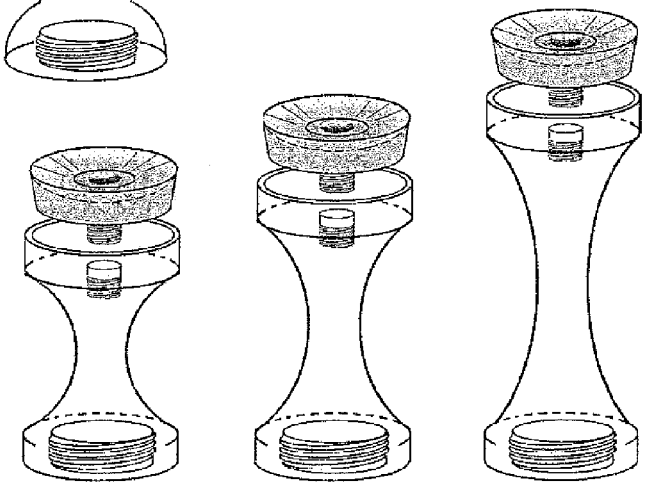
FIG. 16 is a schematic view showing three golf ball engaging portions in different inclination.
Figure 17:
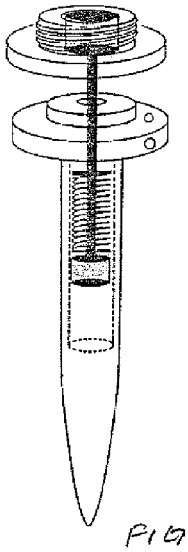
FIG. 17 is a schematic view showing part of the longer golf tee shown in FIG. 1.

In a fourth embodiment in accordance with the present invention, there is also provided with a golf tee similar to the longer golf tee. However, the upper portion has a longitudinal axis which is substantially vertical and not inclined, as shown in FIG. 16. It is envisaged that upper portions of different angle of inclination may be provided in a golf tee kit or a kit of golf accessories having a number of upper portions with different inclination such that a user may choose which of the upper portions suitable for their use in a particular terrain or hit. It is envisaged that due to the removable and replaceable nature of the upper portion (and also the leveling assisting means), in the event of breakage of for example the golf ball supporting means, only replacement of that part is necessary.

It is to be noted that in the above embodiment, no elongate spring means extending along the vertical length of the golf ball supporting portion 8 is provided therein. Although the upper enlarged end 42 still resides in the golf supporting portion 8, its function is mainly to connect the golf ball supporting portion 8 to the ground engaging portion 9, and it is relatively small in size and short in vertical height. It is to be understood that there is only provided just enough or very little room for accommodating the enlarged upper end 42 in the golf supporting portion 8. With this design, there is thus no need for the upper enlarged end 8 to move along the vertical distance in the golf supporting portion 8. This is advantageous because if any further room other than the room for accommodating the enlarged upper end 42 is reserved for any spring means or any movable means then the golf ball supporting means 8 could not be designed to be very short in length. The absence of spring means or other cavity in the golf ball supporting means 8 allows the reduction of its length to a minimal. In other words, with the golf supporting portion 8 not having any cavity in which the enlarged upper portion 8 is movable, there is less limitation to the length of the golf supporting portion 8 and it can be made to be very short, i.e. short enough to generally just accommodating the relatively thin or small upper enlarged end 8. In summary, the present invention will enable a relatively short tee be produced.

It will be appreciated that a variety of other modifications may be included in the present invention or the above embodiments. For example, instead of using a compression spring in the cavity of the ground-engaging portion other resilient means may be used. Although no leveling assisting means is included in the golf ball supporting portion of the shorter golf tee, a suitable leveling assisting means may be introduced.

The invention claimed is:

1. A golf tee comprising:

(a) a ground-engaging portion provided with a cavity therein, (b) a golf ball supporting portion releasably engageable with said ground-engaging portion, (c) means for connecting said ground-engaging portion and said golf ball supporting portion, and (d) spring means for urging said golf ball supporting portion to said ground-engaging portion, wherein said spring means resides and is movable in said cavity, said golf ball supporting portion comprising a base portion and an upper portion releasably engageable to said base portion, said upper portion being threadedly engageable to said base portion.

2. A golf tee as claimed in claim 1 wherein said cavity is generally elongate in shape and leads to an upper opening of said ground-engaging portion.

3. A golf tee as claimed in claim 2 wherein said opening has a smaller width or diameter than the width or diameter of said elongate cavity.

4. A golf tee as claimed in claim 1 wherein said connecting means is resilient in nature.

5. A golf tee as claimed in claim 1 wherein said connecting means is made of a plastic(s) material.

6. A golf tee as claimed in claim 1 wherein said connecting means is generally elongate in shape with a lower end having an enlarged flange secured in said cavity.

7. A golf tee as claimed in claim 6 wherein said flange of which is movable along said elongate cavity.

8. A golf tee as claimed in claim 1 wherein a lower end of said connecting means is secured within said cavity of said ground engaging means.

9. A golf tee as claimed in claim 8 wherein said spring means acts on the lower end of said connecting means and pushes said lower end towards a lower end of said cavity or said ground-engaging portion.

10. A golf tee as claimed in claim 1 wherein said connecting means connects said base portion of said golf ball supporting portion and said ground-engaging portion in said cavity.

11. A golf tee as claimed in claim 1 wherein said upper portion is replaceable with another upper portion of different length.

12. A golf tee as claimed in claim 1 wherein said golf ball supporting means is provided with means for assisting the leveling of said golf tee on the ground.

13. A golf tee as claimed in claim 12 wherein said assisting means is releasably engageable with said golf tee or said golf ball supporting means.

14. A golf tee comprising:

(a) a ground-engaging portion provided with a cavity therein, (b) a golf ball supporting portion releasably engageable with said ground-engaging portion, (c) means for connecting said ground-engaging portion and said golf ball supporting portion, and (d) spring means for urging said golf ball supporting portion to said ground-engaging portion, wherein said spring means resides and is movable in said cavity, said golf ball supporting means being provided with means for assisting the leveling of said golf tee on the ground, said assisting means being threadedly engageable to said golf ball supporting portion.

15. A golf tee as claimed in claim 1 wherein said golf ball supporting means is generally elongate in shape and is slightly angled relative to said ground-engaging portion and is slightly curved.

16. A golf tee as claimed in claim 1 wherein said golf tee is adapted to assume a first configuration in which said golf ball supporting portion is in contact with said ground-engaging portion, and a second configuration in which said golf ball supporting portion is out of contact with said ground-engaging portion.

17. A kit of golf accessory comprising at least two golf tees, at least one of which is the golf tee as claimed in claim 1, or claim 14.

18. A golf tee as claimed in claim 1 wherein said golf ball supporting means is generally elongate in shape and is slightly curved relative to said ground-engaging portion.

* * * * *